US005313729A

United States Patent [19]

Sakai et al.

[11] Patent Number: 5,313,729

[45] Date of Patent: May 24, 1994

[54] LED DISPLAY UNIT

[75] Inventors: Hiroo Sakai; Shingo Otobe; Hideo Tamura; Toshimi Kamikawa, all of Kanagawa, Japan

[73] Assignee: Stanley Electric Co., Ltd., Tokyo, Japan

[21] Appl. No.: 871,756

[22] Filed: Apr. 21, 1992

[30] Foreign Application Priority Data

May 2, 1991 [JP] Japan ..... 3-40111

[51] Int. Cl.[5] ..... G09F 3/04

[52] U.S. Cl. ..... 40/452; 362/227; 362/240

[58] Field of Search ..... 40/452, 575, 576; 362/800, 227, 240, 294, 373, 812

[56] References Cited

U.S. PATENT DOCUMENTS 4,882,667 11/1989 Skegin ..... 362/294

5,003,443 3/1991 Sabala ..... 362/812

5,036,248 7/1991 McEwan et al. ..... 40/452

*Primary Examiner*—Kenneth J. Dorner

*Assistant Examiner*—J. Silbermann

*Attorney, Agent, or Firm*—Nixon & Vanderhye

[57] ABSTRACT

An LED display unit comprises a printed circuit board. A plurality of LEDs are packaged on the printed circuit board. Portions of the respective LEDs except for light emitting sections thereof are sealed by a resin. The LEDs having the portions thereof sealed by the resin are received in a case. A plurality of the cases are arranged on the attaching plate, to form a large-sized display panel. The case has a rear face thereof which is brought to a configuration in which spaces exist between the attaching plate and portions of the case except for a fixing portion thereof to the attaching plate and a connector for wiring.

5 Claims, 5 Drawing Sheets

LED DISPLAY UNIT

BACKGROUND OF THE INVENTION

The present invention relates to an LED (light emitting diode) display unit used for forming an LED large-sized display panel or board for the outdoor.

An LED display unit of the kind referred to above is constructed as follows as shown in a front elevational view of FIG. 8 of the attached drawings and in a cross-sectional view of FIG. 9 thereof taken along a line IX—IX in FIG. 8. That is, a plurality of LEDs 2 are packaged on a printed circuit board 1, and portions of the respective LEDs 2 except for light-emitting sections thereof are sealed by a resin 3 to form an LED arrangement. The LED arrangement is received in, for example, a case 4 which is formed of a plastic material. A plurality of cases 4, in each of which the LED arrangement has been received, are arranged on an attaching plate 5 or are fixedly mounted on the attaching plate 5 by respective screws 6, thereby to form a large-sized display panel. In this connection, the reference numeral 7 denotes lead wires which extend rearwardly from the printed circuit board 1 through a back or rear wall of the case 4 and the attaching plate 5.

The above-described conventional LED display unit is of construction in which an entire back face of the case 4 is mounted on the attaching plate 5 in close contact therewith. For this reason, there is a problem that an efficiency of heat radiation from the back face of the case 4 is deteriorated so that portions of the LEDs 2 are liable to be heated to a high temperature. In the future, LED large-sized display panels for the outdoors, which are high in luminance or brightness and which are wide in viewing, will be required, and it will be required to package many more LEDs 2 onto the printed circuit boards 1. However, the LED display unit having the above-described construction will not be able to meet this requirement.

SUMMARY OF THE INVENTION

It is therefore an object of the invention to provide an LED display unit in which an efficiency of heat radiation from a rear face of a case is superior and, as a result, the number of LEDs capable of being packaged on a printed circuit board increases so that it is possible to form an LED large-sized display panel for the outdoor, which is high in luminance and which is wide in viewing.

According to the invention, there is provided an LED display unit comprising:

a printed circuit board;

a plurality of LEDs packaged on the printed circuit board;

a resin by which portions of the respective LEDs except for light emitting sections thereof are sealed;

an attaching plate;

a case in which the LEDs having the portions thereof sealed by the resin are received, a plurality of the cases being arranged on the attaching plate, to form a large-sized display panel; and a connector for wiring, for said case, wherein the case has a rear face thereof which is brought to a configuration in which spaces exist between the attaching plate and the portions of said case except for a fixing portion thereof to the attaching plate and said connector for wiring.

With the above arrangement of the invention, the spaces between the attaching plate and the portions of the case other than the fixing portion of the case to the attaching plate and the connector for wiring at the rear of the case fulfill duties of ventilation bores. Accordingly, an efficiency of heat radiation from the rear face of the case is improved considerably, and heat conduction from the printed circuit board to the rear face of the case through the resin and subsequent heat radiation become excellent. Thus, LED portions become difficult to be heated to a high temperature.

As described above, the LED display unit according to the invention has the following advantages which are important in practical use. That is, the efficiency of heat radiation from the rear face of the case becomes excellent. As a result, the number of LEDs, which can be packaged on the printed circuit board, increases so that it is possible to form an LED large-sized display panel for the outdoor, which is high in luminance and which is wide in viewing.

DETAILED DESCRIPTION OF THE DRAWINGS

DESCRIPTION OF THE EMBODIMENTS

Figure 8:
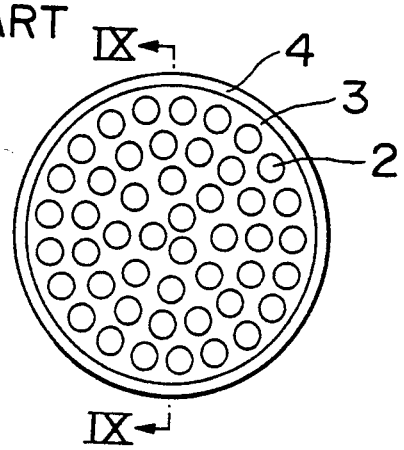
FIG.8 PRIOR ART
FIG. 8 is a front elevational view of a conventional LED display unit.
Figure 9:
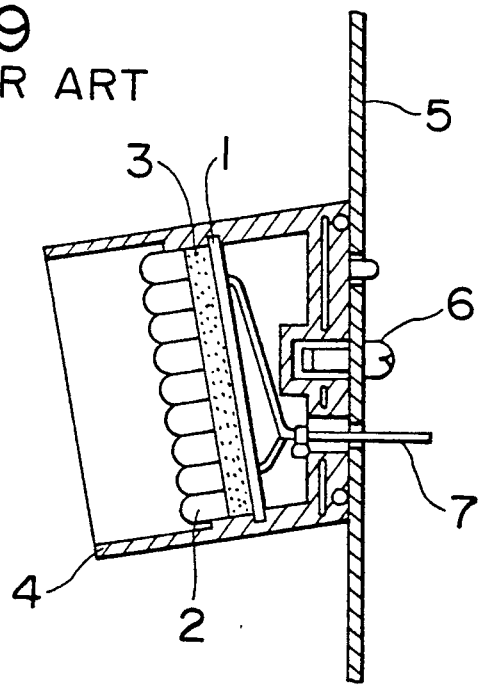
FIG.9 PRIOR ART
FIG. 9 is a cross-sectional view taken along a line IX—IX in FIG. 8.

Embodiments of the invention will hereunder be described in detail with reference to the accompanying drawings. In this connection, components and parts identical with those of the conventional arrangement illustrated in FIGS. 8 and 9 are designated by the same or similar reference numerals, and the description of the same or similar components and parts will be omitted or simplified for simplification.

Referring first to FIGS. 1 through 4, there is shown an LED display unit according to an embodiment of the invention.

The reference numeral 7 denotes four (4) legs which are provided respectively at four (4) corners of a rear face of a case 4. Two (2) of the legs 7, which are located symmetrically to each other through 180°, are fixedly mounted on an attaching plate 5 by a fixing screw (not shown), and the other two legs 7 are abutted against the attaching plate 5. The reference numeral 8 denotes a connector for wiring to a plurality of LEDs 2, which is provided on a central section of the rear face of the case 4 as a projection and which has a forward end extending through the attaching plate 5. The arrangement is of configuration that spaces 9 exist between the attaching plate 5 and portions of the case 4 except for the connector 8 and the legs 7 on the rear face of the case 4. In this connection, in FIG. 2, the reference numeral 10 denotes a rubber packing for preventing a resin 3 from leaking.

Figure 1:
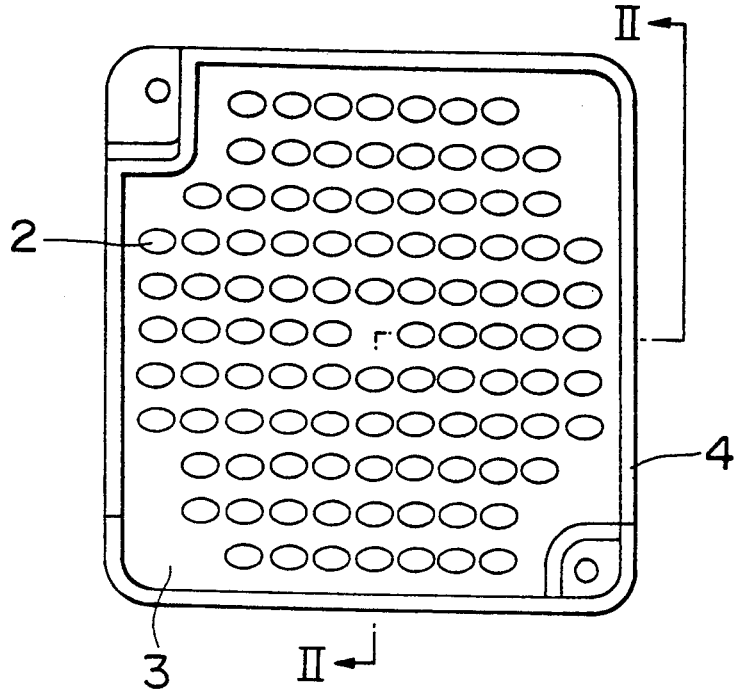
FIG. 1 is a front elevational view of an LED display unit according to an embodiment of the invention.
Figure 2:
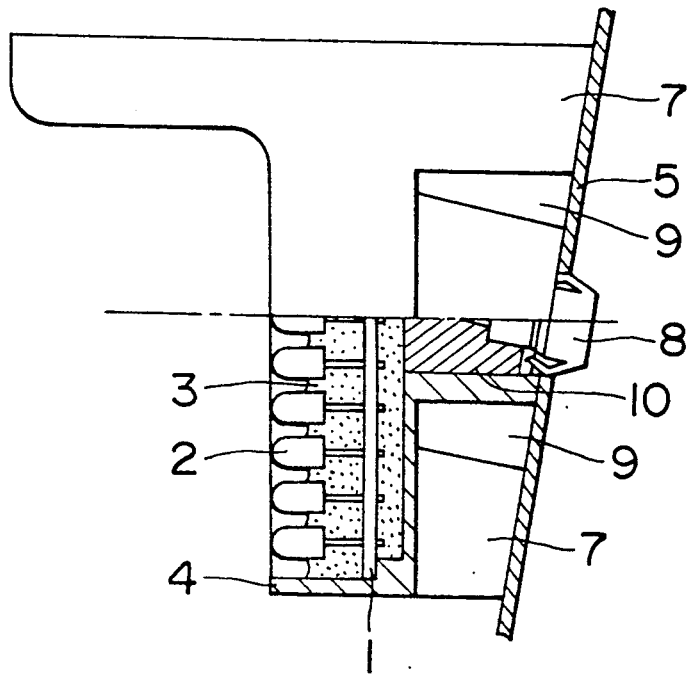
FIG. 2 is a partially broken-away, side elevational view taken along a line II—II in FIG. 1.
Figure 3:
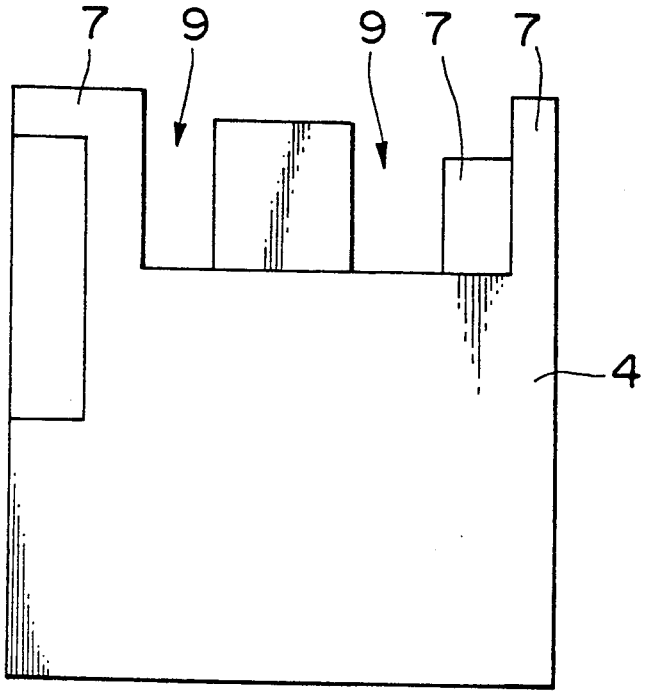
FIG. 3 is a top plan view of the above-described embodiment.
Figure 4:
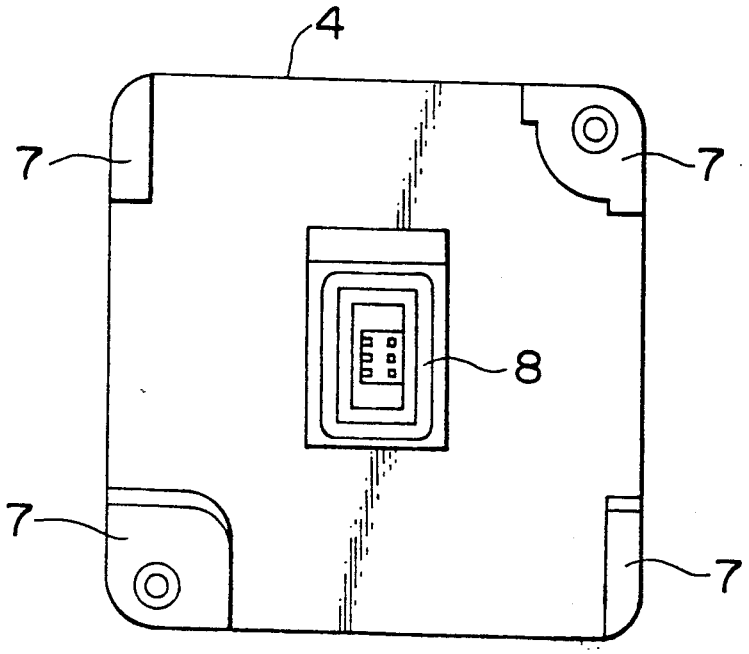
FIG. 4 is a rear view of the above-described embodiment.
Figure 5:
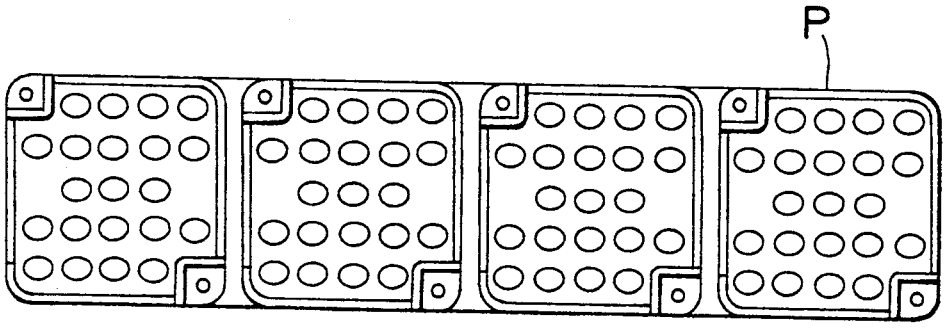
FIG. 5 is a front elevational view of an LED large-sized display panel for the outdoor, which comprises a plurality of LED display units one of which is illustrated in FIG. 1.

The embodiment has been constructed as described above. Since the spaces 9 between the attaching plate 5 and the portions of the case 4 except for the connector 8 and the legs 7 on the rear face of the case 4 fulfill their duties as ventilation bores, an efficiency of heat radiation from the rear face of the case 4 is improved considerably. In fact, the efficiency has risen through approximately 15% as compared with the aforesaid conventional arrangement. Accordingly, heat conduction from a printed circuit 1 to the rear face of the case 4 through the resin 3 and subsequent heat radiation become superior or excellent, so that the portions of the LEDs 2 become difficult to be heated to a high temperature. As a result, the number of the LEDs 2, which can be packaged on the printed circuit board 1, increases. Thus, it is possible to form an LED large-sized display panel P for the outdoor, which is high in luminance and which is wide in viewing, as shown in FIG. 5.

In connection with the above, in order to generate heat convection within the spaces 9, it is desirable that the spacing between the rear face of the case 4 and the attaching plate 5 is at least 5 mm. Further, if the case 4 is formed of a material such as aluminum, it is possible to further raise the efficiency of heat radiation.

Figure 6:
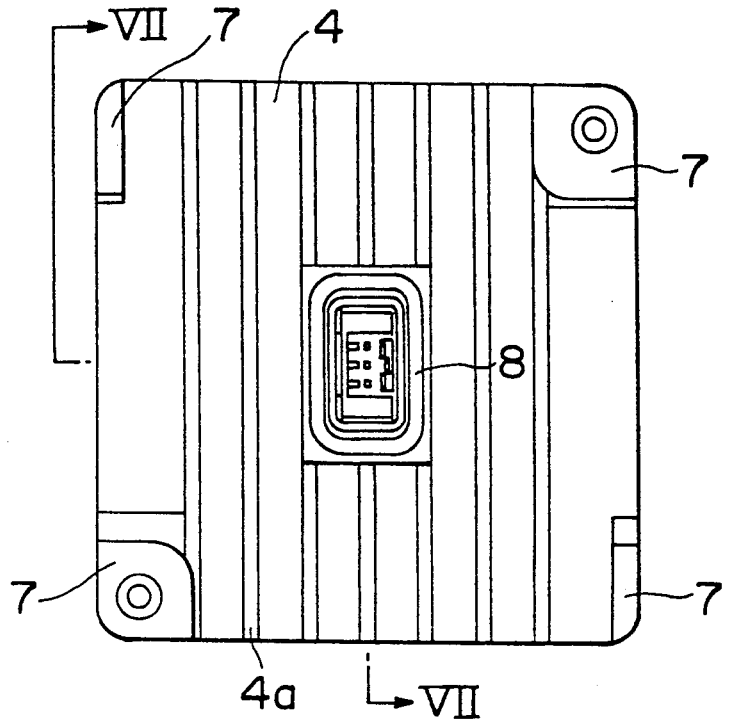
FIG. 6 is a rear view of another embodiment according to the invention.
Figure 7:
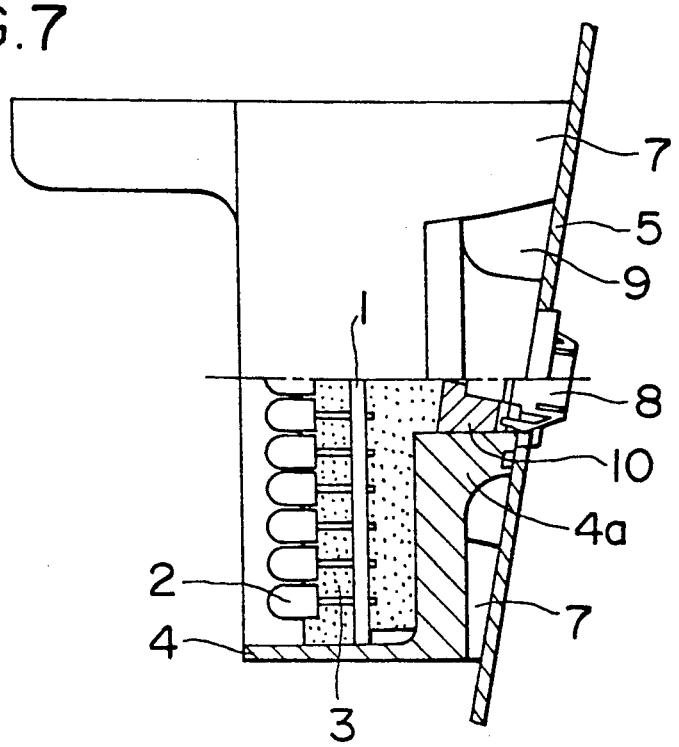
FIG. 7 is a cross sectional view taken along a line VII—VII in FIG. 6.

Moreover, as shown in the rear view of FIG. 6 and the cross-sectional view of FIG. 7, taken along the line VII—VII in FIG. 6, if a plurality of heat-radiation fins 4*a* are provided on the rear face of the case 4, it is possible to more further improve the efficiency of heat radiation.

What is claimed is:

1. An LED display unit comprising:

a printed circuit board;

a plurality of LEDs packaged on said printed circuit board;

a resin by which portions of said LEDs except for light-emitting sections thereof are sealed;

an attaching plate;

a case in which said LEDs having the portions thereof sealed by said resin are received, a plurality of said cases being arranged on said attaching plate to form a large-sized display panel with each case having a rear face and four legs projecting from four corners of the rear face of the case with at least a pair of said legs securing said case and said attaching plate to one another; and a connector for each said case for wiring to said printed circuit board;

the rear face of each said case being spaced from said attaching plate, each case being configured such that spaces are extant between said attaching plate and said rear face and between said legs and said wiring connector.

2. An LED display unit according to claim 1, wherein two of said four legs are located symmetrically to each other through 180°, and are fixedly mounted to said attaching plate, and another two of said four legs are abutted against said attaching plate.

3. An LED display unit according to claim 1, wherein spacing between the rear face of each said case and said attaching plate is at least 5 mm.

4. An LED display unit according to claim 1, wherein each said case is formed of aluminum.

5. An LED display unit according to claim 1, including a plurality of heat-radiation fins on the rear face of at least one of said case.

* * * * *